US011415943B2

(12) United States Patent
Okamura et al.

(10) Patent No.: US 11,415,943 B2
(45) Date of Patent: Aug. 16, 2022

(54) DISPLAY MEMBER AND TIMEPIECE

(71) Applicant: CASIO COMPUTER CO., LTD., Tokyo (JP)

(72) Inventors: Naoki Okamura, Tachikawa (JP); Kentaro Maru, Higashikurume (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 662 days.

(21) Appl. No.: 16/128,657

(22) Filed: Sep. 12, 2018

(65) Prior Publication Data

US 2019/0086871 A1 Mar. 21, 2019

(30) Foreign Application Priority Data

Sep. 15, 2017 (JP) ..... JP2017-177909

(51) Int. Cl.
*G04B 19/32* (2006.01)
*G04B 19/12* (2006.01)

(52) U.S. Cl.
CPC ..... *G04B 19/32* (2013.01); *G04B 19/12* (2013.01)

(58) Field of Classification Search
CPC ..... G04B 19/12; G04B 19/30; G04B 19/305; G04B 19/32; G01R 1/08; G01D 13/20
See application file for complete search history.

(56) References Cited

U.S. PATENT DOCUMENTS 1,388,855 A * 8/1921 Rufusg ..... G04B 19/32 40/542
1,626,383 A * 4/1927 Boedtcher ..... B66B 3/00 40/615
2,261,578 A * 11/1941 Bauer ..... G09F 7/14 428/29
2,376,305 A * 5/1945 Bauer ..... G09F 7/165 428/68
2,652,652 A * 9/1953 Lasko ..... B60K 37/02 40/546
2,885,561 A * 5/1959 Lange ..... G04B 19/32 250/463.1
3,675,295 A * 7/1972 Feller ..... G04D 3/0043 29/896.32

(Continued)

FOREIGN PATENT DOCUMENTS

CH 348115 A * 7/1960 ..... G04B 19/32
CN 2593240 Y 12/2003

(Continued)

OTHER PUBLICATIONS

Machine Translation of JPS55162181 (Year: 2021).*

(Continued)

*Primary Examiner* — Edwin A. Leon
*Assistant Examiner* — Jason M Collins
(74) *Attorney, Agent, or Firm* — Scully Scott Murphy & Presser

(57) ABSTRACT

A display member including a plate member which has light transparency, a display insertion section which is provided in the plate member such that a front surface thereof is convex and a rear surface corresponding to the convex portion is concave, and a light reaction material which is embedded in the display insertion section emits light in response to light.

20 Claims, 6 Drawing Sheets

(56) References Cited

U.S. PATENT DOCUMENTS

| | | | | | |
|---|---|---|---|---|---|
| 4,875,433 | A * | 10/1989 | Tsukamoto | G01D 11/28 116/335 |
| 5,741,058 | A * | 4/1998 | Suzuki | B60K 35/00 362/23.16 |
| 6,170,958 | B1 * | 1/2001 | Chien | F21S 8/035 362/84 |
| 6,208,593 | B1 * | 3/2001 | Liao | G04B 19/32 368/228 |
| 6,295,251 | B1 * | 9/2001 | Sakai | G04B 19/065 368/232 |
| 6,904,866 | B2 * | 6/2005 | Furuya | G01D 11/28 116/286 |
| 9,316,511 | B2 * | 4/2016 | Mochizuki | G01D 13/04 |
| 9,465,364 | B2 | 10/2016 | Willemin et al. | |
| 2015/0241848 | A1 | 8/2015 | Willemin et al. | |
| 2019/0369562 | A1 * | 12/2019 | Bonke | G04B 39/00 |

FOREIGN PATENT DOCUMENTS

| | | | | |
|---|---|---|---|---|
| CN | 1470962 | A | 1/2004 | |
| FR | 952305 | A * | 11/1949 | G04B 19/32 |
| FR | 1211992 | A * | 3/1960 | G04B 19/10 |
| GB | 2030171 | A * | 4/1980 | C09K 11/04 |
| JP | S46-009890 | Y1 | 4/1971 | |
| JP | S55-162181 | U | 11/1980 | |
| JP | H04-079287 | U | 7/1992 | |
| JP | H10-306278 | A | 11/1998 | |
| JP | 2005-221236 | A | 8/2005 | |
| JP | 2015-530578 | A | 10/2015 | |

OTHER PUBLICATIONS

First Office Action dated Apr. 30, 2020 received in Chinese Patent Application No. CN 201811075783.4 together with an English language translation.

Second Office Action dated Dec. 7, 2020 received in Chinese Patent Application No. CN 201811075783.4 together with an English language translation.

Notice of Reasons for Refusal dated Nov. 13, 2019 received in Japanese Patent Application No. JP 2017-177909 together with an English language translation.

* cited by examiner

DISPLAY MEMBER AND TIMEPIECE

CROSS-REFERENCE TO RELATED APPLICATION

This application is based upon and claims the benefit of priority from the prior Japanese Patent Application No. 2017-177909, filed Sep. 15, 2017, the entire contents of which are incorporated herein by reference.

BACKGROUND

1. Field of the Invention

The present invention relates to a display member used in an electronic device such as a wristwatch and a timepiece including the display member.

2. Description of the Related Art

For example, the dial plate of a wristwatch is known which includes a light accumulating fluorescent sheet having a substrate on which a light accumulating fluorescent substance is coated and has a structure in which a transparent sheet having a condensing function is overlapped on the light accumulating fluorescent sheet which emits fluorescent light from the light accumulating fluorescent substance through the transparent plate, as described in Japanese Patent Application Laid-Open (Kokai) Publication No. 10-306278.

However, since the dial plate of the wristwatch has the structure in which the light accumulating fluorescent substance is coated on the flat surface of the substrate, the light accumulating fluorescent substance does not have a sufficient thickness. For this reason, sufficient brightness and stereoscopic emission of light cannot be acquired because light is only emitted from the entire surface of substrate. Thus, the dial plate lacks in fanciness.

SUMMARY

In accordance with one embodiment, there is provided a display member comprising: a plate member which has light transparency; a display insertion section which is provided in the plate member such that a front surface thereof is convex and a rear surface corresponding to the convex portion is concave; and a light reaction material which is embedded in the display insertion section emits light in response to light.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

An embodiment applied to a wristwatch will be described below with reference to FIG. 1 to FIG. 5A and FIG. 5B.

Figure 1:
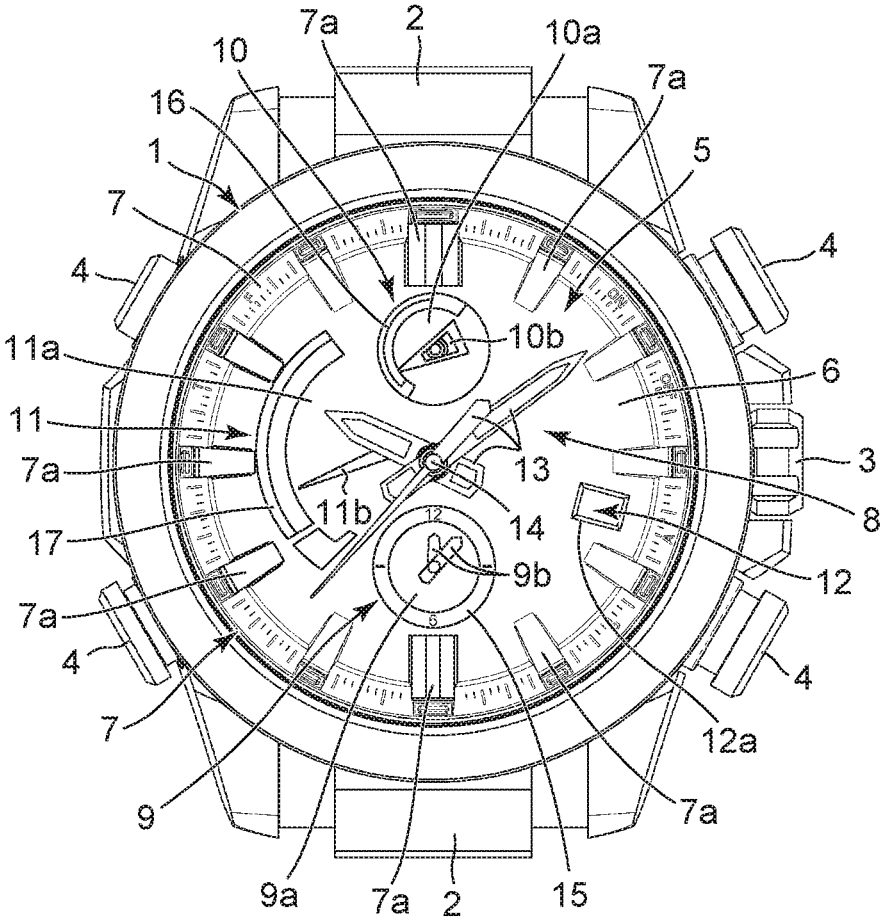
FIG. 1 is an enlarged front view showing an embodiment acquired by applying the present invention to a wristwatch.

This wristwatch includes a wristwatch case 1, as shown in FIG. 1. Band attaching sections 2 are arranged on side portions of the wristwatch case 1 on the 12 o'clock side and 6 o'clock side, respectively.

On the side portion of the wristwatch case 1 on the 3 o'clock side, a switch operation section 3 such as a crown is arranged, as shown in FIG. 1. On the side portions of the wristwatch case 1 on the 2 o'clock side, the 4 o'clock side, the 8 o'clock side, and the 10 o'clock side, push buttons switches 4 are arranged, respectively. Inside the wristwatch case 1, a timepiece module 5 is arranged.

The timepiece module 5 includes a disk-shaped dial plate 6 arranged on the upper surface thereof and a ring-shaped parting member 7 arranged on the outer peripheral portion of the upper surface of the dial plate 6, as shown in FIG. 1. On the upper surface of the parting member 7, a plurality of numeric characters 7*a* are arranged at equal intervals along the circumferential direction.

The timepiece module 5 includes a main display section 8 indicating current time, a first sub-display section 9 indicating world time, a second sub-display section 10 indicating a day of the week, a third sub-display section 11 indicating the battery remaining amount, and a date display section 12 indicating a date, as shown in FIG. 1.

The main display section 8 indicates current time, and includes pointers 13 such as a second hand, a minute hand, and a hour hand operating above the dial plate 6 and a pointer shaft 14 which projects upward at the center portion of the dial plate 6 and to which the pointers 13 are attached, as shown in FIG. 1. By this structure, on the main display section 8, the pointers 13 operate above the dial plate 6 according to the rotation of the pointer shaft 14 to indicate the numeric character 7*a* in the parting member 7, whereby current time is indicated.

The first sub-display section 9 is a section indicating current time in one of the cities in the world, as shown in FIG. 1. The first sub-display section 9 includes a substantially circular first display area 9*a* arranged between the central portion of the dial plate 6 and the outer periphery of the dial plate 6 on the 6 o'clock side and a first sub-pointer 9*b* operating in the first display area 9*a*. By this structure, in the first sub-display section 9, the first sub-pointer 9*b* operates in the first display area 9*a* to indicate time in a selected city.

The second sub-display section 10 is a section indicating a day of the week, and includes a substantially circular second display area 10*a* arranged between the central portion of the dial plate 6 and the outer periphery of the dial plate 6 on the 12 o'clock side and a second sub-pointer 10*b* operating in the second display area 10*a*, as shown in FIG. 1. By this structure, in the second sub-display section 10, the second sub-pointer 10*b* operates in the second display area 10*a* to selectively indicate a day of the week.

The third sub-display section 11 is a section indicating the battery remaining amount, and includes a substantially fan-shaped third display area 11*a* arranged between the central portion of the dial plate 6 and the outer periphery of the dial plate 6 on the 9 o'clock side and a third sub-pointer 11*b* operating in the third display area 11*a*, as shown in FIG. 1. By this structure, in the third sub-display section 11, the third sub-pointer 11*b* operates in the third display area 11*a* to indicate the battery remaining amount.

The date display section 12 is a section indicating a date and includes a ring-shaped date indicator indicating a date of 1 to 31 (neither of them is shown) and a date window 12*a* which is arranged on the outer peripheral portion of the dial plate 6 on the 3 o'clock side and to which any date of the date indicator corresponds, as shown in FIG. 1. By this structure, the date display section 12 is structured such that any date of the date indicator can be visually recognized through the date window 12*a*.

The dial plate 6 is structured by a plate-shaped mold having a small thickness and made of a synthetic resin having light transparency, such as a transparent or semi-transparent synthetic resin, as shown in FIG. 1 to FIG. 4. On the dial plate 6, a first display insertion section 15 corresponding the first sub-display section 9, a second display insertion section 16 corresponding to the second sub-display section 10, and a third display insertion section 17 corresponding to the third sub-display section 11 are arranged. The first display insertion section 15, the second display insertion section 16, and the third display insertion section 17 are arranged by using a structure for avoiding the occurrence of sink marks in the molded component.

The first display insertion section 15 is arranged in a substantially circular shape along the outer periphery of the first display area 9*a* of the first sub-display section 9, as shown in FIG. 1 to FIG. 4. The first display insertion section 15 is formed such that it has a groove shape that is convex toward the front surface of the dial plate 6, and the rear surface corresponding to the convex portion is concave, as shown in FIG. 5A. More specifically, the first display storage is formed such that its cross-sectional shape is a substantially square shape.

Accordingly, the first display insertion section 15 includes an upper surface portion 15*a* projecting on the front surface side of the dial plate 6 while being substantially parallel with the front surface of the dial plate 6 and a side surface portion 15*b* arranged around the upper surface portion 15*a* and projecting on the front surface side of the dial plate 6, as shown in FIG. 5A. The first display insertion section 15 is structured such that the rear surface sides of the upper surface portion 15*a* and the side surface portion 15*b* are open and a groove whose cross section has a substantially square shape is formed on the rear surface side of the dial plate 6.

The second display insertion section 16, on the outer periphery of the second display area 10*a* of the second sub-display section 10, is arranged in a semi-circular ring shape over a range of the 9 o'clock side to the 1 o'clock side in the clockwise direction, as shown in FIG. 1 to FIG. 4. The second display insertion section 16 is formed such that it has a groove shape that is convex toward the front surface of the dial plate 6, and the rear surface corresponding to the convex portion is concave, as with the first display insertion section 15, as shown in FIG. 5B.

Figure 5A:
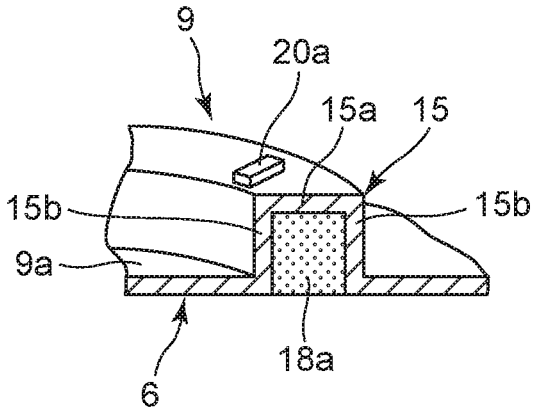
FIG. 5A shows the display insertion section of the dial plate shown in FIG. 2 and is an enlarged perspective view of a main part taken along line A to A in FIG. 2.
Figure 5B:
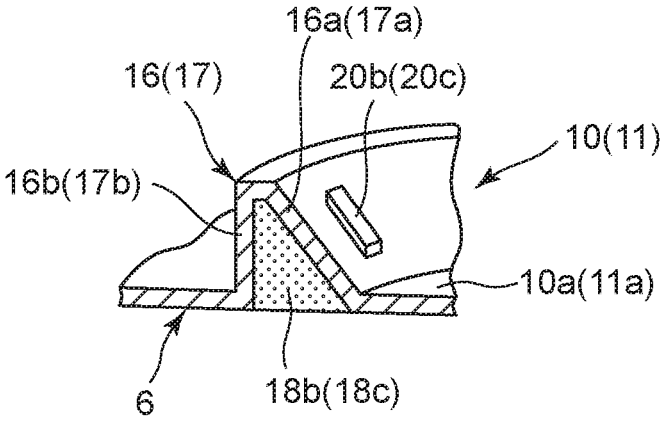
FIG. 5B shows the display insertion section of the dial plate shown in FIG. 2 and is an enlarged perspective view of a main part taken along line B to B in FIG. 2.

More specifically, the second display insertion section 16 is formed such that its cross-sectional shape is a substantially right-triangular shape, as shown in FIG. 5B. Accordingly, the second display insertion section 16 includes a slope portion 16*a* obliquely projecting on the front surface side of the dial plate 6 and a side surface portion 16*b* substantially vertically standing on the front surface side of the dial plate 6, and they project in substantially right-triangular shapes on the front surface of the dial plate 6.

The second display insertion section 16 is structured such that the rear surface sides corresponding to the slope portion 16*a* and the side surface portion 16*b* and a groove whose cross section has a substantially right-triangular shape is formed on the rear surface side of the dial plate 6, as shown in FIG. 5B. The slope portion 16*a* of the second display insertion section 16 is located on the inner periphery side of the second display area 10*a* and slopes toward the central portion of the second display area 10*a*. The side surface portion 16*b* of the second display insertion section 16 is located on the outer periphery side of the second display area 10*a* and stands on the front surface of the dial plate 6.

Furthermore, the third display insertion section 17, on the outer periphery of the third display area 11*a* of the third sub-display section 11, is arranged in an arc shape over a range of the 8 o'clock side to the 11 o'clock side in the clockwise direction, as shown in FIG. 1 to FIG. 4. The third display insertion section 17 is formed such that it has a groove shape that is convex toward the front surface of the dial plate 6, and the rear surface corresponding to the convex portion is concave, as with the second display insertion section 16, as shown in FIG. 5B.

More specifically, the third display insertion section 17 is formed such that its cross-sectional shape is a right-triangular shape, as shown in FIG. 5B. This third display insertion section 17 includes a slope portion 17*a* obliquely projecting on the front surface side of the dial plate 6 and a side surface portion 17*b* vertically standing on the front surface side of the dial plate 6, and they project in substantially right-angular shapes on the front surface side of the dial plate 6, as with the second display insertion section 16.

The third display insertion section 17 is structured such that rear surface sides corresponding to the slope portion 17*a* and the side surface portion 17*b* are open and a groove whose cross section has a substantially right-angular shape is formed on the rear surface side of the dial plate 6, as shown in FIG. 5B. The slope portion 17*a* of the third display insertion section 17 is located on the inner periphery side of the fan-shaped third display area 11*a*, and slopes toward the central portion serving as a cornerstone of the fan in the third display area 11*a*. The side surface portion 17*b* of the third display insertion section 17 is located on the outer periphery side of the third display area and stands on the front surface of the dial plate 6.

Figure 4:
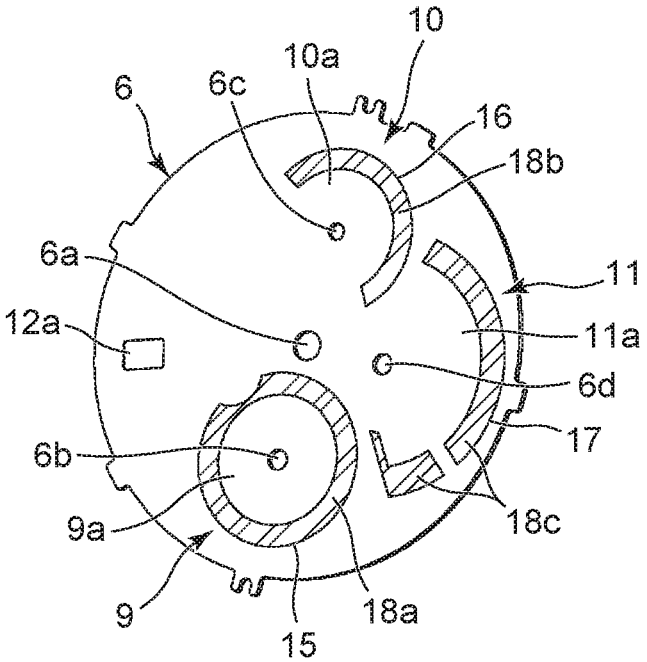
FIG. 4 is an enlarged perspective view showing a state in which a light accumulating material has been embedded in a display insertion section of the dial plate shown in FIG. 3.

On the other hand, inside the first to third display insertion sections 15 to 17, first to third light accumulating materials 18*a* to 18*c* which emit light in response to light are embedded, as shown in FIG. 4, FIG. 5A and FIG. 5B, respectively. More specifically, the first to third light accumulating materials 18*a* to 18*c* are embedded inside the first to third display insertion sections 15 to 17, respectively, and are formed to have lower surfaces on the same plane as that of the rear surface of the dial plate 6.

Accordingly, the first to third light accumulating materials 18*a* to 18*c* are separately embedded inside the first to third display insertion sections 15 to 17 with sufficient thicknesses and sufficient capacities, as shown in FIG. 4, FIG. 5A and FIG. 5B. As a result, the first to third light accumulating materials 18*a* to 18*c* are structured to have sufficiently high brightness within each section of the first to third display insertion sections 15 to 17 emit light.

More specifically, the first to third light accumulating materials 18*a* to 18*c* accumulate external light as light energy and emit light in a dark place by the accumulated light energy, as shown in FIG. 4, FIG. 5A and FIG. 5B. The colors of the lights from the first to third light accumulating materials 18*a* to 18*c* may be white or any color such as blue, green, and yellow. The first to third light accumulating materials 18*a* to 18*c* embedded in the first to third display insertion sections 15 to 17 may be structured to emit lights in the same color. However, they may be structured to emit lights in different colors for each of the first to third display insertion sections 15 to 17.

The first to third light-accumulating materials 18*a* to 18*c* are structured to accumulate external light as light energy by the external light entering through projecting portions of the first to third display insertion sections 15 to 17 on the front surface side of the dial plate 6 having light transparency, as shown in FIG. 4, FIG. 5A and FIG. 5B.

The first to third light accumulating materials 18*a* to 18*c* are structured such that light is emitted with high brightness in a dark place by the accumulated light energy and the emitted light is discharged to the upper side of the dial plate 6 through portions of the first to third display insertion sections 15 to 17 projecting on the front surface side of the dial plate 6 to stereoscopically illuminate the upper surface side of the dial plate 6, as shown in FIG. 4, FIG. 5A and FIG. 5B.

On the front surfaces of the first to third display insertion sections 15 to 17 projecting from the front surface of the dial plate 6, first to third display sections 20*a* to 20*c* which regulate transparency of light and display information such as a scale or a mark are arranged, respectively, as shown in FIGS. 5A and 5B. For example, in the first display insertion section 15, the first display sections 20*a* are arranged at a plurality of predetermined portions on the upper surface portion 15*a* projecting from the front surface of the dial plate 6.

The first sub-display section 9 is structured such that, when the first light accumulating material 18*a* in the first display insertion section 15 emits light to cause the upper surface portion 15*a* of the first display insertion section 15 to emit light, even though the light is blocked by the first display section 20*a*, it is discharged from the other portions of the upper surface portion 15*a* except for the first display section 20*a* to vividly show the first display section 20*a* displaying information such as a scale or a mark, as shown in FIG. 5A.

The first display section 20*a* may be arranged in the entire area of the upper surface portion 15*a* of the first display insertion section 15. In this case, even though the entire area of the upper surface portion 15*a* is blocked by the first display section 20*a*, the side surface portion 15*b* emits light so as to illuminate the front surface of the dial plate 6 as in illumination. The depth of the first display insertion section 15 in which the first light accumulating material 18*a* is embedded is set to be larger than the thickness of the dial plate 6.

In the second display insertion section 16, the second display sections 20*b* are arranged at a plurality of predetermined portions on the slope portion 16*a* projecting from the front surface of the dial plate 6, respectively, as shown in FIG. 5B. The second sub-display section 10 is structured such that, when the second light accumulating material 18*b* in the second display insertion section 16 emits light and the light is discharged from the slope portion 16*a* of the second display insertion section 16, even though the discharged light is blocked by the second display section 20*b*, the light is discharged from the other portions of the slope portion 16*a* except for the second display section 20*b* so that the second display section 20*b* which display information such as a scale or a mark is vividly shown, as with the first sub-display section 9.

Furthermore, in the third display insertion section 17, the third display sections 20*c* are arranged at a plurality of predetermined portions on the slope portion 17*a* projecting from the front surface of the dial plate 6, as shown in FIG. 5B. The third sub-display section 11 is structured such that, when the third light accumulating material 18*c* in the third display insertion section 17 emits light and the light is discharged from the slope portion 17*a* of the third display insertion section 17, even though the discharged light is blocked by the third display section 20*c*, the light is discharged from the other portions of the slope portion 17*a* except for the third display section 20*c* so that the third display section 20*c* which display information such as a scale or a mark is vividly shown, as with the second sub-display section 10.

Figure 2:
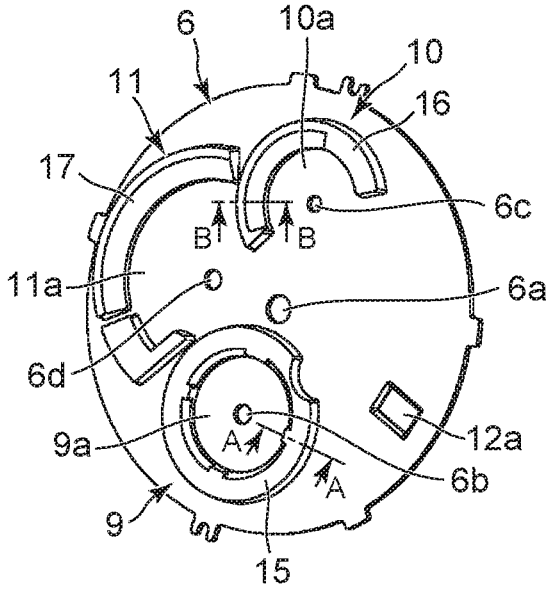
FIG. 2 is an enlarged perspective view showing the dial plate of the wristwatch shown in FIG. 1 when viewed from the front surface side thereof.
Figure 3:
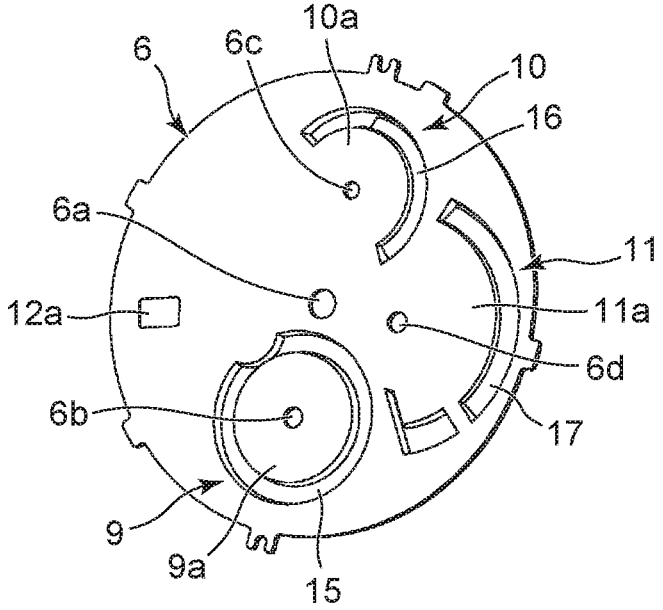
FIG. 3 is an enlarged perspective view showing the dial plate shown in FIG. 2 when viewed from the rear surface side thereof.

The dial plate 6 has provided therein a through hole 6*a* into which the pointer shaft 14 of the main display section 8 is inserted, a through hole 6*b* into which the pointer shaft (not shown) of the first sub-display section 9 is inserted, a through hole 6*c* into which the pointer shaft (not shown) of the second sub-pointer 10*b* of the second sub-display section 10 is inserted, and a through hole 6*d* into which the pointer shaft (not shown) of the third sub-pointer 11*b* of the third sub-display section 11, as shown in FIG. 2 to FIG. 4.

Next, the mechanism of the wristwatch described above will be described below.

In the wristwatch, in a usual state, the pointer shaft 14 of the main display section 8 rotates to operate the pointers 13 such as a second hand, a minute hand, and an hour hand above the dial plate 6, and the pointers 13 indicate numeric characters 7*a* of the parting member 7 arranged on the outer periphery of the dial plate 6 so as to inform the user of current time.

Here, the first sub-pointer 9*b* of the first sub-display section 9 operates in the first display area 9*a* and indicates the first display section 20*a* so as to inform the user of time in one of the cities in the world. Similarly, in the second sub-display section 10, the second sub-pointer 10*b* operates in the second display area 10*a* and indicates a day of the week of the second display section 20*b* so as to inform the user of the day of the week.

Furthermore, here, the third sub-pointer 11*b* of the third sub-display section 11 operates in the third display area 11*a* and indicates the scale of the third display section 20*c* so as to inform the user of the battery remaining amount. Similarly, in the date display section 12, the date indicator on which dates 1 to 31 are displayed rotates along the inner peripheral surface of the wristwatch case 1 to set a state in which any one of the dates on the date indicator can be visually recognized through the date window 12*a*, so that the user can know the date.

When the wristwatch is used in a bright place, external light is irradiated on the front surface of the dial plate 6, and the irradiated external light is transmitted through the dial plate 6. Here, the external light enters the first to third display insertion sections 15 to 17 respectively arranged in the first to third sub-display sections 9 to 11, and causes the first to third light accumulating materials 18*a* to 18*c* embedded in the first to third display insertion sections 15 to 17 to accumulate light energy.

More specifically, in the first display insertion section 15 of the first sub-display section 9, the external light enters the first display insertion section 15 from the upper surface portion 15*a* and the side surface portion 15*b*, and is irradiated on the first light accumulating material 18*a* in the first display insertion section 15. The irradiated light causes the first light accumulating material 18*a* in the first display insertion section 15 to accumulate light energy. Here, since the first light accumulating material 18*a* embedded in the first display insertion section 15 has a large thickness and a large capacity, the first light accumulating material 18*a* accumulates sufficient light energy.

In the second display insertion section 16 of the second sub-display section 10, external light enters the second display insertion section 16 from the slope portion 16*a* and the side surface portion 16*b*, and is irradiated on the second light accumulating material 18*b* in the second display insertion section 16. The irradiated light causes the second light accumulating material 18*b* in the second display insertion section 16 to accumulate light energy. In this case as well, since the second light accumulating material 18*b* embedded in the second display insertion section 16 has a large thickness and a large capacity, the second light accumulating material 18*b* accumulates sufficient light energy.

Similarly, in the third display insertion section 17 of the third sub-display section 11, external light enters the third display insertion section 17 from the slope portion 17*a* and the side surface portion 17*b*, and is irradiated on the third light accumulating material 18*c* in the third display insertion section 17. The irradiated light causes the third light accumulating material 18*c* in the third display insertion section 17 to accumulate light energy. In this case as well, since the third light accumulating material 18*c* embedded in the third display insertion section 17 has a large thickness and a large capacity, the third light accumulating material 18*c* accumulates sufficient light energy.

When the wristwatch is used in a dark place, the first to third light accumulating materials 18*a* to 18*c* embedded in the first to third display insertion sections 15 to 17 respectively arranged on the first to third sub-display sections 9 to 11 of the dial plate 6 emit light with high brightness. More specifically, the first to third light accumulating materials 18*a* to 18*c* embedded in the first to third display insertion sections 15 to 17 respectively have thick thicknesses and large capacitance, and thus brightness becomes high when light is emitted.

Also, since the first to third display insertion sections 15 to 17 projects from the front surface of the dial plate 6, the first to third light accumulating materials 18*a* to 18*c* in the projecting first to third display insertion sections 15 to 17 stereoscopically emit light above the dial plate 6. More specifically, the lights emitted by the first to third light accumulating materials 18*a* to 18*c* are discharged from the portions of the first to third display insertion sections 15 to 17 projecting from the front surface of the dial plate 6 to the upper side of the dial plate 6.

Accordingly, the first to third light accumulating materials 18*a* to 18*c* in the first to third display insertion sections 15 to 17 stereoscopically emit light above the dial plate 6 so as to cause the first to third display insertion sections 15 to 17 to brightly illuminate the first to third sub-display sections 9 to 11, respectively. Thus, the user can favorably visually recognize the first to third sub-display sections 9 to 11.

In the first sub-display section 9, since the first display insertion section 15 is formed in a substantially circular ring shape along the outer periphery of the first display area 9*a*, when the first light accumulating material 18*a* embedded in the first display insertion section 15 emits light, the first display insertion section 15 illuminates the outer periphery of the first display area 9*a* in a substantially circular ring shape.

More specifically, when the first light accumulating material 18*a* in the first display insertion section 15 emits light, since the emitted light is discharged from the upper surface portion 15*a* and the side surface portion 15*b* of the first display insertion section 15 located above the dial plate 6, the first light accumulating material 18*a* stereoscopically emits the light above the dial plate 6 and favorably illuminates the first display area 9*a*.

Here, since the first display sections 20*a* displaying information such as a scale and a mark are arranged at a plurality of predetermined portions on the upper surface portion 15*a* of the first display insertion section 15, light emitted from the first light accumulating material 18*a* in the first display insertion section 15 is blocked by the first display sections 20*a*. However, the light is discharged from the other portions of the upper surface portion 15*a* except for the first display sections 20*a*. As a result, the user can visually clearly recognize the first display sections 20*a* displaying information such as a scale or a mark and arranged on the upper surface portion 15*a* of the first display insertion section 15, and therefore can favorably know the time in a city selected from the cities in the world even in a dark place.

In the second sub-display section 10, on the outer periphery of the second display area 10*a*, the second display insertion section 16 is formed in a semi-circular ring shape over a range of the 9 o'clock side to the 1 o'clock side in the clockwise direction. Accordingly, when the second light accumulating material 18*b* embedded in the second display insertion section 16 emits light, the second display insertion section 16 illuminates the outer periphery of the second display area 10*a* in a substantially semi-arc shape.

More specifically, when the second light accumulating material 18*b* in the second display insertion section 16 emits light, since the emitted light is discharged on the upper side of the dial plate 6 from the slope portion 16*a* and the side surface portion 16*b* of the second display insertion section 16 located above the dial plate 6, the second light accumulating material 18*b* stereoscopically emits the light above the dial plate 6 to favorably illuminate the second display area 10*a*.

Here, since the second display sections 20*b* displaying information such as a scale and a mark are arranged at a plurality of predetermined portions on the slope portion 16*a* of the second display insertion section 16, the light emitted from the second light accumulating material 18*b* in the second display insertion section 16 is blocked by the second display sections 20*b*. However, the light is discharged from the other portions of the slope portion 16*a* except for the second display sections 20*b*. As a result, the user can visually clearly recognize the second display sections 20*b* displaying the information such as a scale or a mark and arranged on the slope portion 16*a* of the second display insertion section 16, and therefore can favorably know a day of the week even in a dark place.

Similarly, in the third sub-display section 11, since the third display insertion section 17 is arranged in an arc shape over a range of the 8 o'clock side to the 11 o'clock side in the clockwise direction on the outer periphery of the third display area 11*a*, when the third light accumulating material 18*c* embedded in the third display insertion section 17 emits light, the third display insertion section 17 illuminates the outer periphery of the third display area 11*a* in an arc shape.

More specifically, when the third light accumulating material 18*c* in the third display insertion section 17 emits light, since the emitted light is discharged on the upper side of the dial plate 6 from the slope portion 17*a* and the side surface portion 17*b* of the third display insertion section 17 located above the dial plate 6, the third light accumulating material 18*c* stereoscopically emits the light above the dial plate 6 to favorably illuminate the third display area 11*a*.

In this case as well, since the third display sections 20*c* displaying information such as a scale and a mark are arranged at a plurality of predetermined portions on the slope portion 17*a* of the third display insertion section 17, the light emitted from the third light accumulating material 18*c* in the third display insertion section 17 is blocked by the third display sections 20*c*. However, the light is discharged from the other portions of the slope portion 17*a* except for the third display sections 20*c*. As a result, the user can visually clearly recognize the third display sections 20*c* displaying the information such as a scale and a mark and arranged on the slope portion 17*a* of the third display section 17, and therefore can favorably know the battery remaining amount even in a dark place.

Also, the first to third display insertion sections 15 to 17 have different shapes, respectively, and the first to third light accumulating materials 18*a* to 18*c* is embedded in the first to third display insertion sections 15 to 17 having these different shapes. Accordingly, when the first to third light accumulating materials 18*a* to 18*c* emit light, the emitted light in different shapes will illuminate the first to third sub-display sections 9 to 11 in accordance with the shapes of the first to third display insertion sections 15 to 17. Consequently, fanciness is enhanced and improved design can be achieved.

The first to third light accumulating materials 18*a* to 18*c* embedded in the first to third display insertion sections 15 to 17 emit light of the same color. However, when the colors of the light emitted from the first to third light accumulating materials 18*a* to 18*c* are different from each other, colorful light emission can be achieved. For this reason, by also changing the colors of light from the first to third light accumulating materials 18*a* to 18*c* to be different from each other, fanciness is enhanced and improved design can be achieved.

As such, the wristwatch includes the dial plate 6 that is a plate member having light transparency, the first to third display insertion sections 15 to 17 provided on the dial plate 6 such that each of their front surfaces is convex and each of their rear surfaces corresponding thereto is concave, and the first to third light accumulating materials 18*a* to 18*c* respectively embedded in the first to third display insertion sections 15 to 17 so as to emit light in response to light. Accordingly, the first to third light accumulating materials 18*a* to 18*c* can be improved in brightness, and the first to third light accumulating materials 18*a* to 18*c* can be caused to stereoscopically emit light on the front surface side of the dial plate 6, whereby fanciness is enhanced.

More specifically, in the wristwatch, since the first to third light accumulating materials 18*a* to 18*c* is embedded in the first to third display insertion sections 15 to 17 projecting on the front surface side of the dial plate 6, the thicknesses of the first to third light accumulating materials 18*a* to 18*c* can be increased, and the capacity of the first to third light accumulating materials 18*a* to 18*c* can be increased.

Thus, in this wristwatch, since the emission brightness of the first to third light accumulating materials 18*a* to 18*c* in the first to third display insertion sections 15 to 17 can be improved in emission brightness, when the first to third light accumulating materials 18*a* to 18*c* emit light, the front surfaces of the first to third display insertion sections 15 to 17 can be caused to emit light with high brightness. As a result, the front surface side of the dial plate 6 can be favorably illuminated.

Also, in this wristwatch, since the first to third display insertion sections 15 to 17 are provided on the dial plate 6 such that each of their front surfaces is convex and each of their rear surfaces corresponding thereto is concave, the first to third light accumulating materials 18*a* to 18*c* embedded in the first to third display insertion sections 15 to 17 can be arranged such that the first to third light accumulating materials 18*a* to 18*c* project upward from the front surface of the dial plate 6. Accordingly, when the first to third light accumulating materials 18*a* to 18*c* emit light, the first to third light accumulating materials 18*a* to 18*c* can be caused to stereoscopically emit light on the front surface side of the dial plate 6, whereby fanciness and design are improved.

Moreover, in this wristwatch, by the first to third display insertion sections 15 to 17 being provided at a plurality of portions of the dial plate 6 with them having different groove shapes, the first to third light accumulating materials 18*a* to 18*c* can be embedded in the first to third display insertion sections 15 to 17 in a manner to have thick thicknesses and large capacitance, and the first to third light accumulating materials 18*a* to 18*c* can be caused to emit light in different shapes.

More specifically, in this wristwatch, since the first to third light accumulating materials 18*a* to 18*c* embedded in the first to third display insertion sections 15 to 17 can cause the plurality of portions of the dial plate 6 to stereoscopically emit light with high brightness, the first to third light accumulating materials 18*a* to 18*c* in the first to third display insertion sections 15 to 17 can brightly illuminate the front surface side of the dial plate 6 along groove shapes different from each other.

In this case, in the first display insertion section 15, the first display insertion section 15 is formed in a substantially circular ring shape along the outer periphery of the first display area 9*a* of the first sub-display section 9. Accordingly, when the first light accumulating material 18*a* embedded in the first display insertion section 15 emits light, the outer periphery of the first display area 9*a* can be caused to emit light in a ring shape on the front surface side of the dial plate 6.

More specifically, since the first light accumulating material 18*a* in the first display insertion section 15 can discharge emitted light from the upper surface portion 15*a* and the side surface portion 15*b* of the first display insertion section 15 projected from the front surface of the dial plate 6 to the front surface side of the dial plate 6, the first display insertion section 15 can be caused to stereoscopically emit light on the front surface side of the dial plate 6, so that the first display area 9*a* can be favorably stereoscopically illuminated.

In the second display section 10, on the outer periphery of the second display area 10*a*, the second display insertion section 16 is formed in a substantially circular ring shape over a range of the 9 o'clock side to the 1 o'clock side in the clockwise direction. Accordingly, when the second light accumulating material 18*b* embedded in the second display insertion section 16 emits light, the outer periphery of the second display area 10*a* can be caused to emit light in a stereoscopically semi-circular shape, on the front surface side of the dial plate 6.

More specifically, since the second light accumulating material 18*b* in the second display insertion section 16 can discharge emitted light from the slope portion 16*a* and the side surface portion 16*b* of the second display insertion section 16 projecting from the front surface of the dial plate 6 to the front surface side of the dial plate 6, the second display insertion section 16 can be caused to stereoscopically emit light on the front surface side of the dial plate 6, so that the second display area 10*a* can be favorably stereoscopically illuminated.

Furthermore, in the third sub-display section 11, on the outer periphery of the third display area 11*a*, the third display insertion section 17 is formed in an arc shape over a range from the 8 o'clock side to the 11 o'clock side in the clockwise direction. Accordingly, when the third light accumulating material 18*c* embedded in the third display insertion section 17 emits light, the outer periphery of the third display area 11*a* can be caused to emit light in a stereoscopically and arc shape on the front surface side of the dial plate 6.

More specifically, since the third light accumulating material 18*c* in the third display insertion section 17 discharge light from the slope portion 17*a* and the side surface portion 17*b* of the third display insertion section 17 projecting from the front surface of the dial plate 6 to the front surface side of the dial plate 6, the third display insertion section 17 can be caused to stereoscopically emit light on the front surface side of the dial plate 6, so that the third display area 11*a* can be favorably stereoscopically illuminated.

Also, the first to third display insertion sections 15 to 17 have different shapes, and the first to third light accumulating materials 18*a* to 18*c* are embedded in the first to third display insertion sections 15 to 17 having different shapes. Accordingly, when the first to third light accumulating materials 18*a* to 18*c* emit light, the emitted light can cause the first to third display insertion sections 15 to 17 to emit light in shapes different from each other in accordance with the shapes. Thus, fanciness is enhanced and improved design can be further achieved.

The first to third light accumulating materials 18*a* to 18*c* embedded in the first to third display insertion sections 15 to 17 emit light of the same color when emitting light. However, when the colors of lights emitted from the first to third light accumulating materials 18*a* to 18*c* are different from each other, colorful light emission can be achieved. For this reason, by also changing the colors of lights from the first to third light accumulating materials 18*a* to 18*c* to be different from each other, fanciness is enhanced and improvement in the design is achieved.

Also, in this wristwatch, the first to third display areas 20*a* to 20*c* regulating the transparency of light to display information are arranged on the surfaces of the first to third display insertion sections 15 to 17 projecting from the front surface side of the dial plate 6, whereby light emitted from the first to third light accumulating materials 18*a* to 18*c* is blocked by the first to third display sections 20*a* to 20*c*. However, since light is discharged from the front surfaces of the first to third display insertion sections 15 to 17 except for the first to third display sections 20*a* to 20*c*, the first to third display sections 20*a* to 20*c* can be clearly recognized.

More specifically, since the first display sections 20*a* displaying information such as a scale and a mark are arranged at a plurality of predetermined portions on the upper surface portion 15*a* of the first display insertion section 15, light emitted from the first light accumulating material 18*a* in the first display insertion section 15 is blocked by the first display sections 20*a*. However, since the light is discharged from the other portions of the upper surface portion 15*a* except for the first display sections 20*a*, the user can clearly and visually recognize the first display sections 20*a* displaying information such as a scale and a mark and arranged on the upper surface portion 15*a* of the first display insertion section 15 even in a dark place.

Also, since the second display sections 20*b* displaying information such as a scale and a mark are arranged at a plurality of predetermined portions on the slope portion 16*a* of the second display insertion section 16, light emitted from the second light accumulating material 18*b* in the second display insertion section 16 is blocked by the second display sections 20*b*. However, since the light is discharged from the other portions of the slope portion 16*a* except for the second display sections 20*b*, the user can visually clearly recognize the second display sections 20*b* displaying information such as a scale and a mark and arranged on the slope portion 16*a* of the second display insertion section 16 even in a dark place.

Moreover, since the third display sections 20*c* displaying information such as a scale and a mark are arranged at a plurality of predetermined portions on the slope portion 17*a* of the third display insertion section 17, light emitted from the third light accumulating material 18*c* in the third display insertion section 17 is blocked by the third display sections 20*c*. However, since the light is discharged from the other portions of the slope portion 17*a* except for the third display sections 20*c*, the user can visually clearly recognize the third display sections 20*c* displaying information such as a scale and a mark and arranged on the slope portion 17*a* of the third display insertion section 17 even in a dark place.

In the above-described embodiment, the first to third light accumulating materials 18*a* to 18*c* are embedded in the first to third display insertion sections 15 to 17, respectively. However, the present invention is not limited thereto and, for example a structure may be adopted in which light emitting materials that emit visible light in response to ultraviolet light are embedded in the first to third display insertion sections 15 to 17. In this structure, an ultraviolet light emitting element need only be arranged on the inner peripheral surface of the wristwatch case 1 located above the dial plate 6.

In the wristwatch structured as described above, when the ultraviolet light emitting element is caused to emit ultraviolet light, the ultraviolet light enters from the front surfaces of the first to third display insertion sections 15 to 17 on the insides thereof, and the light emitting material reacts on the ultraviolet light to emit visible light. Accordingly, even though the light emitting material is used, the light emitting material can be caused to emit light with high brightness and can be caused to stereoscopically emit light, as in the embodiment described above.

In the above-described embodiment, the first display insertion section 15 is formed to have a groove shape such that its cross-sectional shape is a substantially square shape and the second and third display insertion sections 16 and 17 are formed to have groove shapes such that each of their cross-sectional shapes is a substantially right-triangular shape. However, the present invention is not limited thereto. For example, as the display insertion sections, a display insertion sections 21 or 22 as in a first modification shown in FIG. 6A or a second modification shown in FIG. 6B may be formed on the dial plate 6.

Figure 6A:
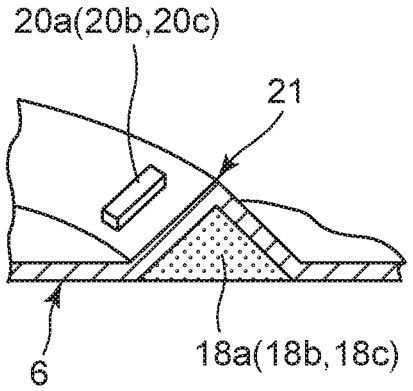
FIG. 6A shows a modification of the display insertion section of the dial plate shown in FIGS. 5A and 5B and is an enlarged perspective view showing a main part of this first modification which has been partially cut.
Figure 6B:
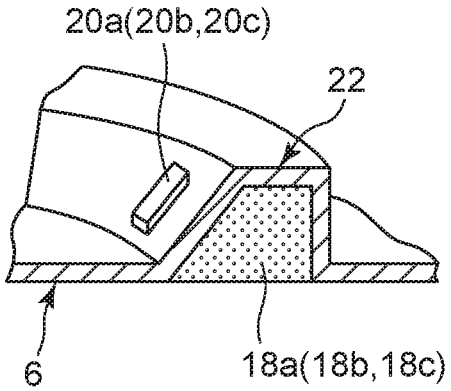
FIG. 6B shows a modification of the display insertion section of the dial plate shown in FIGS. 5A and 5B and is an enlarged perspective view showing a main part of this second modification which has been partially cut.

More specifically, the display insertion section 21 in the first modification shown in FIG. 6A is structured such that it projects in a chevron shape from the front surface of the dial plate 6 and a groove whose cross section has an inverted V shape is formed on the rear surface side corresponding to the front surface. Also, the display insertion section 22 in the second modification shown in FIG. 6B is structured such that it projects in a substantially trapezoidal shape from the front surface of the dial plate 6 and a groove whose cross section has an inverted trapezoid shape is formed on the rear surface side corresponding to the front surface. By this display insertion section 21 or 22 serving as the display insertion section of the invention, the same operational effect as in the embodiment is acquired.

Also, the present invention is not limited to the embodiment described above and, as a display insertion section, a display insertion section may be formed which projects from the front surface of the dial plate 6 such that its cross section has a semi-arc shape and a groove whose cross section has a semi-arc shape is formed on the rear surface side corresponding to the front surface. By this display insertion section as well, the same operational effect as in the embodiment can be acquired.

Moreover, the present invention is not limited to the embodiment described above, and a structure may be adopted in which a solar panel is arranged on the rear surface of the dial plate 6. In this structure, since the dial plate 6 has light transparency, external light is illuminated on the solar panel through the dial plate 6, and high-brightness light emitted from the light accumulating material 18 is illuminated on the solar panel. Accordingly, the solar panel can be caused to favorably generate electric power.

In the above-mentioned embodiment and the modifications thereof, the present invention is applied to the dial plate 6. However, the present invention is not necessarily required to be applied to the dial plate 6 and, for example, can be applied to the parting member 7. In that case, the parting member 7 is formed using a transparent material, and the numeric character 7*a* of the parting member 7 is provided as a display insertion section of which the front surface is convex and the rear surface corresponding thereto is concave.

Furthermore, in the above-mentioned embodiment and the modifications thereof, the present invention is applied to a wristwatch. However, the present invention is not necessarily required to be applied to a wristwatch and, for example, can be applied to various types of timepieces such as a travel wristwatch, an alarm clock, a stand clock, and a wall clock. Still further, the present invention is not necessarily required to be applied to a timepiece, and can be widely applied to an electronic device such as a mobile terminal or a cell-phone.

While the present invention has been described with reference to the preferred embodiments, it is intended that the invention be not limited by any of the details of the description therein but includes all the embodiments which fall within the scope of the appended claims.

What is claimed is:

1. A display member comprising:

a plate member which has light transparency, wherein the plate member comprises:

a display section having a thickness in a direction; and a display insertion section having light transparency, wherein a front surface of the display insertion section is convex and a rear surface of the display insertion section is concave and is provided behind the front surface to form a groove, and wherein the groove has depth in the direction, the depth being greater than the thickness of the display section; and a light reaction material which is embedded in the groove in the display insertion section to stereoscopically emit light through the display insertion section in a direction from the rear surface to the front surface of the display insertion section.

2. The display member according to claim 1, wherein the light reaction material is a light accumulating material.

3. The display member according to claim 1, wherein the light reaction material is a light emitting material that emits visible light in response to ultraviolet light.

4. The display member according to claim 1, wherein a plurality of portions of the plate member comprises a plurality of the display insertion section, each having different groove shapes.

5. A timepiece comprising the display member according to claim 1.

6. The display member according to claim 1, comprising a projection provided on the front surface of the display insertion section of the plate member, wherein the projection is less light transparent than at least a portion of the display insertion section of the plate member surrounding the projection.

7. The display member according to claim 1, wherein a cross-sectional shape of the display insertion section is a square shape.

8. The display member according to claim 7, comprising a projection provided on the front surface of the display insertion section of the plate member, wherein the projection is less light transparent than at least a portion of the display insertion section of the plate member surrounding the projection.

9. The display member according to claim 8, wherein the projection is provided on a portion of the front surface of the display insertion section of the plate member that is parallel to the display section of the plate member.

10. The display member according to claim 1, wherein a cross-sectional shape of the display insertion section is a right-triangular shape.

11. The display member according to claim 10, comprising a projection provided on the front surface of the display insertion section of the plate member, wherein the projection is less light transparent than at least a portion of the display insertion section of the plate member surrounding the projection.

12. The display member according to claim 11, wherein the projection is provided on a slope portion of the front surface of the display insertion section of the plate member that obliquely projects from the display section.

13. The display member according to claim 1, wherein a cross-sectional shape of the display insertion section is a chevron shape.

14. The display member according to claim 13, comprising a projection provided on the front surface of the display insertion section of the plate member, wherein the projection is less light transparent than at least a portion of the display insertion section of the plate member surrounding the projection.

15. The display member according to claim 14, wherein the projection is provided on a portion of the front surface of the display insertion section of the plate member that obliquely projects from the display section.

16. The display member according to claim 1, wherein a cross-sectional shape of the display insertion section is a trapezoidal shape.

17. The display member according to claim 16, comprising a projection provided on the front surface of the display insertion section of the plate member, wherein the projection is less light transparent than at least a portion of the display insertion section of the plate member surrounding the projection.

18. The display member according to claim 17, wherein the projection is provided on a portion of the front surface of the display insertion section of the plate member that obliquely projects from the display section.

19. The display member according to claim 1, wherein a cross-sectional shape of the display insertion section is a semi-arc shape.

20. The display member according to claim 1, comprising a solar panel arranged on a rear surface of the plate member, wherein the front surface of the display insertion section projects from a front surface of the plate member.

* * * * *